US006678894B2

(12) United States Patent
Norbutt

(10) Patent No.: US 6,678,894 B2
(45) Date of Patent: Jan. 20, 2004

(54) GOALTENDER'S LEG PAD TOE ANCHOR

(76) Inventor: Steven C. Norbutt, 65 Mahopac Ave., Amawalk, NY (US) 10501

( * ) Notice: Subject to any disclaimer, the term of this patent is extended or adjusted under 35 U.S.C. 154(b) by 117 days.

(21) Appl. No.: 10/142,591

(22) Filed: May 10, 2002

(65) Prior Publication Data

US 2003/0046746 A1 Mar. 13, 2003

Related U.S. Application Data

(60) Provisional application No. 60/290,620, filed on May 14, 2001.

(51) Int. Cl.[7] ..... A41D 13/00
(52) U.S. Cl. ..... 2/22; 2/911
(58) Field of Search ..... 2/22–24, 62, 16, 2/242, 267, 455, 911; 128/846, 878, 882; 36/1.5, 2 R, 72 R, 7.1 R, 114; 602/5, 20, 23, 60, 30, 62

(56) References Cited

U.S. PATENT DOCUMENTS 2,037,964 A * 4/1936 Chochkoff ..... 280/11.3
4,314,707 A * 2/1982 Welch ..... 280/11.209
4,445,287 A 5/1984 Garcia
4,692,946 A * 9/1987 Jurga ..... 2/22
4,868,926 A 9/1989 Lowson
5,172,425 A 12/1992 Smith
5,234,230 A 8/1993 Crane
5,617,580 A * 4/1997 DiCesare et al. ..... 2/22
D382,674 S 8/1997 Minnaar
5,806,092 A 9/1998 Shikatani
5,829,170 A 11/1998 Lutz
6,560,781 B1 * 5/2003 Keene et al. ..... 2/22

OTHER PUBLICATIONS

London's Source for Sports—Goaltenders Equipment Buyers Guide 2000–2001, p. 14 "Toe Arrangements".

* cited by examiner

*Primary Examiner*—Tejash Patel
(74) *Attorney, Agent, or Firm*—Seth Natter; Natter & Natter

(57) ABSTRACT

A goaltender's leg pad toe anchor includes a houve which is secured to the lower portion of a leg pad. Two elongate bands extend downwardly from the houve, with the bands being drawn through and crossed within a toe opening of a skate blade carrier. Each of the bands is releasably attached to a transverse strap which extends beneath the skate from one side of the leg pad to the other. The ends of the bands may be looped, with the transverse strap being threaded through the loops.

18 Claims, 3 Drawing Sheets

GOALTENDER'S LEG PAD TOE ANCHOR

RELATED APPLICATIONS

This application claims the benefit of U.S. Provisional Application No. 60/290,620 filed May 14, 2001.

BACKGROUND OF THE INVENTION

1. Field of the Invention

The present invention relates generally to sports equipment and more specifically to a toe anchor for a hockey goaltender's leg pad.

2. Antecedents of the Invention

Concerns for player's safety led to the development of various types of safety equipment, the use of which was mandated or recommended in conjunction with ice hockey sporting events. A crucial component of a hockey goaltender's equipment comprised leg pads, which provided injury protection and also increased the goaltender's goal blocking abilities.

Proper positioning and attachment of goaltender's leg pads at the optimal anatomic orientation was significant, not only to maximize protection afforded against puck impact and to avoid injury from skate blades, goal posts and the like, but additionally, assured the goaltender's mobility and also maximized goal screening ability.

As illustrated in U.S. Pat. Des. 382,674, issued to MINNAAR et al., goaltender's leg pads typically included a relatively wide, thickly padded front, together with lateral padding, knee padding, a front portion which extended above the goaltender's knee and a depending lower portion which partially covered the toe of the goaltender's skate.

A plurality of leather straps were provided to properly secure the leg pads, with posterior straps engaging the biceps femoris, gastrocnemius and soleus muscle groups. To prevent the leg pads from riding up a goaltender's leg, lateral portions of the pads included one or more transverse straps which extended beneath the sole of the goaltender's skate. Additionally, a toe strap extended from the depending lower portion of the leg pad beneath the sole of the skate. The toe strap included a buckle, with the buckle being subject to rust degradation from contact with ice and, in addition, breakage due to contact with other player's skate blades, hockey sticks, goal posts and the like.

It had also been attempted to employ laces for the purpose of securing to portion of the goaltender's leg pad to the skates. A lace was threaded through holes in a toe bridge, i.e. a skirt or web, which was secured to the lower portion of the leg pad. The lace was wrapped beneath the skate and then drawn above the skate and tied, overlying the skate shank. Laces, however, were difficult to tie, became wet and frayed and were often inadvertently cut on the locker room floor by the goaltender's or other player's skate blades. Further, laces did not retard axial shifting of the leg pads.

SUMMARY OF THE INVENTION

A toe anchor includes a houve or cap which is secured to the depending lower portion of a goaltender's leg pad. The houve is crotched to form two elongate bands which are drawn through and crossed beneath a toe opening of a skate blade carrier.

A goaltender's leg pad transverse shank strap, which is drawn beneath the sole of the skate and through a middle blade carrier opening, is threaded through looped ends of each band to securely anchor the leg pad. Alternatively, a goaltender's leg pad transverse heel strap, which is drawn beneath the heel of the skate and through a heel blade carrier opening, is threaded through looped ends of each band to anchor the leg pad.

The bands are preferably adjustable in length such that the band lengths are sized to accommodate the goaltender's skates and the position of the transverse shank strap or the transverse heel strap, with excess band length being removed after an initial fitting.

From the foregoing compendium, it will be appreciated that it is an aspect of the present invention to provide a goaltender's leg pad toe anchor of the general character described which is not subject to the disadvantages of the antecedents of the invention aforementioned.

A feature of the present invention is to provide a goaltender's leg pad toe anchor of the general character described which is rugged and durable.

A consideration of the present invention is to provide a goaltender's leg pad toe anchor of the general character described which is easy to use.

A further aspect of the present invention is to provide a goaltender's leg pad toe anchor of the general character described which is relatively low in cost.

Another feature of the present invention is to provide a goaltender's leg pad toe anchor of the general character described which is well suited for mass production fabrication.

A further consideration of the present invention is to provide a goaltender's leg pad toe anchor of the general character described which securely anchors the depending lower portion of a leg pad to a goaltender's skate.

Another aspect of the present invention is to provide a goaltender's leg pad toe anchor of the general character described which is free of metal buckles.

Another feature of the present invention is to provide a goaltender's leg pad toe anchor of the general character described which anchors a leg pad through engagement with conventional goal pad transverse straps.

Yet another consideration of the present invention is to provide a goaltender's leg pad toe anchor of the general character described which may be readily fitted to accommodate an individual goaltender's goal pad as well as skate size and style.

To provide an improved method of anchoring a depending lower portion of a goaltender's leg pad to a goaltender's skate is yet a further consideration of the present invention.

Other aspects, features and considerations of the present invention in part will be obvious and in part will be pointed out hereinafter.

With these ends in view, the invention finds embodiment in certain combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which is shown one of the various possible exemplary embodiments of the invention.

DESCRIPTION OF THE PREFERRED EMBODIMENT

Figure 1:
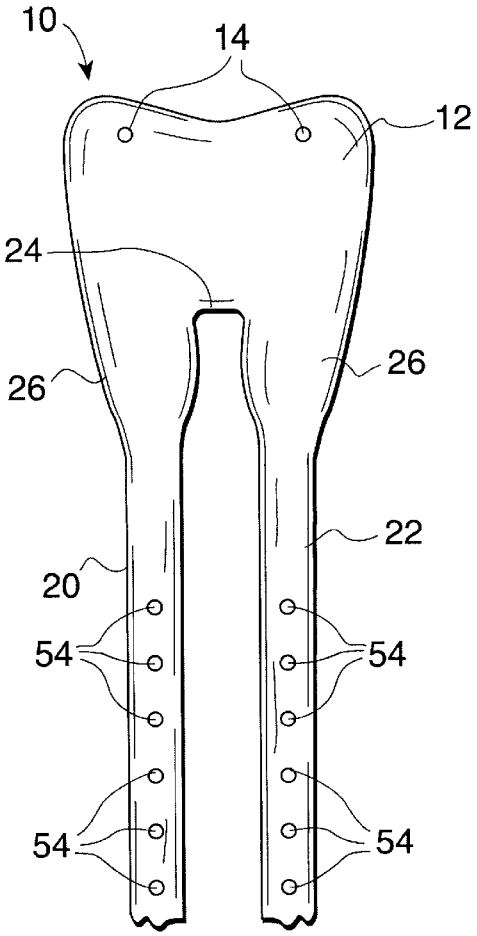
FIG. 1 is a plan view of a goaltender's leg pad toe anchor constructed in accordance with and embodying the invention and showing a houve having apertures for attachment to the depending lower portion of a leg pad and a pair of elongate bands extending from a central crotch.

Referring now in detail to the drawings, the reference numeral 10 denotes generally a goal tender's leg pad toe anchor constructed in accordance with and embodying the invention. The toe anchor 10 is preferably formed of a rugged, durable, web-like material having sufficient strength, durability and resistance to low temperatures and to water degradation to sustain the rigors encountered in the sport of ice hockey. For example, the toe anchor may be comprised of a single leather panel having a thickness within the range of 3–5 mm.

The toe anchor 10 includes an upper houve or cap 12 having a maximum width in the range of 8–10 cm. Adjacent the upper edge of the houve, a pair of spaced apertures 14 are provided. The apertures 14 are spaced apart a distance which corresponds to the spacing of the mounting apertures for conventional buckled toe straps or a toe bridge in a depending lower portion of a leg pad. By way of example, common screw type hockey equipment fasteners 16 extend through the apertures 14 and goal pad mounting apertures in a depending lower portion 18 of the goaltender's leg pad. The fasteners 16 comprise a stubby enlarged head machine screw which engages in internally threaded sockets having an enlarged head. Alternate fasteners such as rivets, common nuts and bolts, clips and hook and loop fasteners may also be utilized.

The toe anchor 10 is bifurcated into a pair of elongate bands 20, 22 at a central crotch 24, with the bands 20, 22 being tapered at a proximal thigh 26. The bands 20, 22 can be of any desired length, and preferably extend to at least the length of a skate blade 28 which is mounted to a skate, designated generally by the reference numeral 30.

The skate 30 generally comprises a boot 32, a sole 34, a blade carrier 36 and the blade 28. Blade carriers may include a plurality of web sections which extend between the blade 28 and the skate sole 34, such as, a forward web 38, a pair of intermediate webs 40, 42 and a rear or heel web 44. The webs 38, 40, 42 and 44 thus define one or more blade carrier transverse openings, i.e. a toe opening 46, a center opening 48 and a heel opening 50. It should be understood that the blade carrier must have at least two webs forming at least one opening.

In fitting the toe anchor 10, the houve is secured to the leg pad lower portion 18 utilizing the hockey screw fasteners 16, after removal of the conventional buckled toe strap or toe bridge. If the toe strap or toe bridge is significantly thicker than the thickness of the toe anchor, either the original hockey screw fasteners can be employed utilizing spacers, or alternatively, shorter hockey screw fasteners 16 may be employed.

Figure 3:
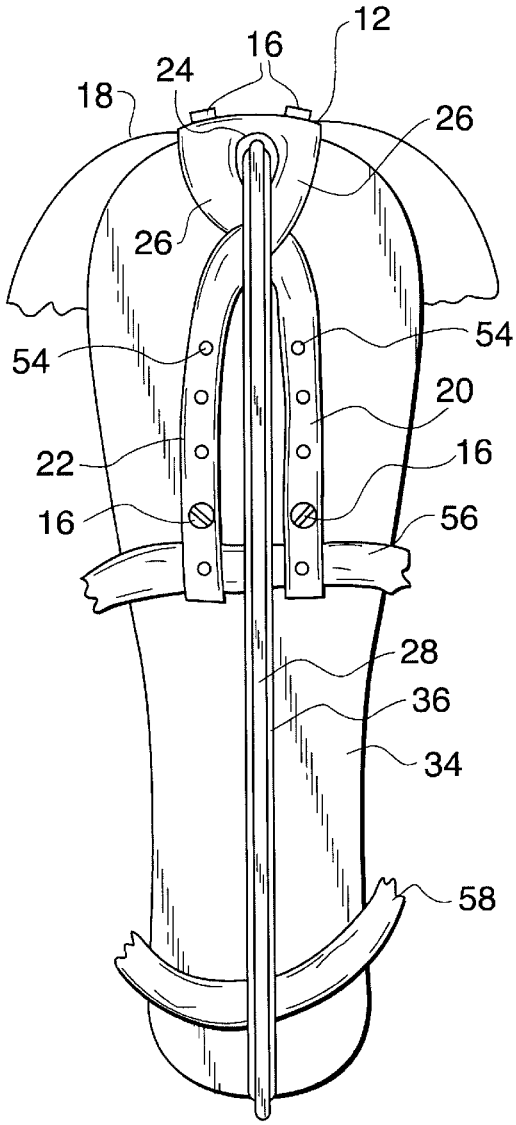
FIG. 3 is a bottom view of the goaltender's skate with portions deleted for clarity and illustrating a fragmentary portion of the leg pad and showing the bands of the toe anchor crossed through a toe opening of a skate blade carrier and with a goaltender's leg pad transverse shank strap being threaded through looped ends of the bands.
Figure 2:
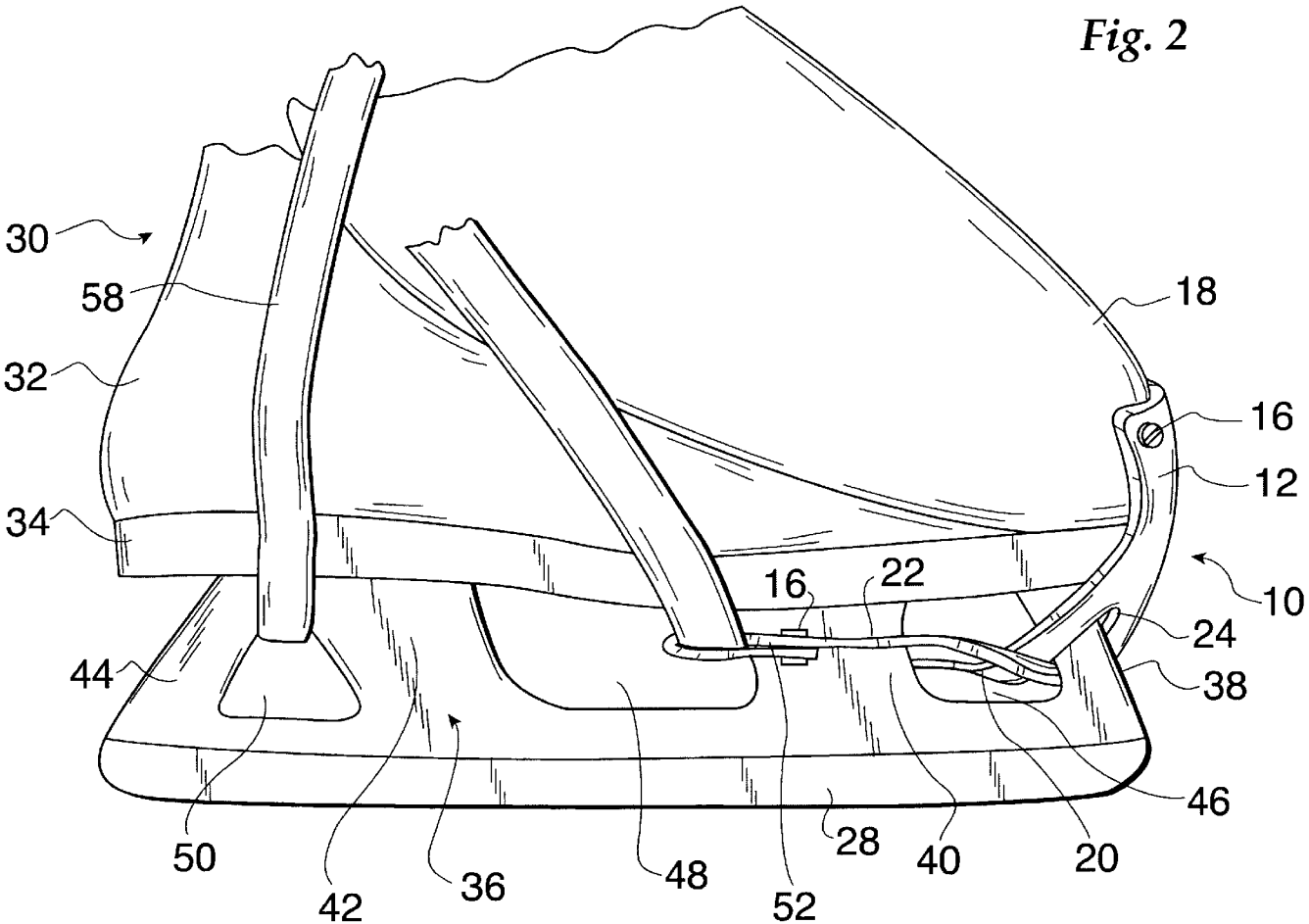
FIG. 2 is a fragmentary side elevational view of a goaltender's skate and with the goaltender's leg having a leg pad, the lower portion of which is secured to the skate by the goaltender's leg pad toe anchor pursuant to the present invention.

The bands 20, 21 are threaded through the blade carrier toe opening 46 and crossed, as illustrated in FIGS. 2 and 3. Thereafter, each of the bands 20, 22 is sized to wrap over a transverse goal pad strap and the overlapped portion is secured to form an end loop 52. It will be noted that there are a plurality of evenly spaced apertures 54 positioned along the length of each band 20, 22. A conventional leg pad transverse shank strap 56 customarily functions only to secure the leg pad by extending from one lateral side of the leg pad through the blade carrier center opening 48, engaging the underside of the skate sole 34 and being secured to the other lateral side of the leg pad.

Once the appropriate position and size of the loop 52 in each band has been determined, e.g. by wrapping around the transverse shank strap 56 when the forward edge of the transverse shank strap 56 engages the web 40, a hockey screw fastener 16 is utilized to close the loop 52 by joining the folded over portion to the band at the registered apertures 54. Excess band material, which extends beyond the engaged apertures, is removed. Thereafter, the toe anchor may be secured by threading the transverse strap from one lateral side of the leg pad through the loops and buckling the transverse strap to the other lateral side of the leg pad.

Figure 4:
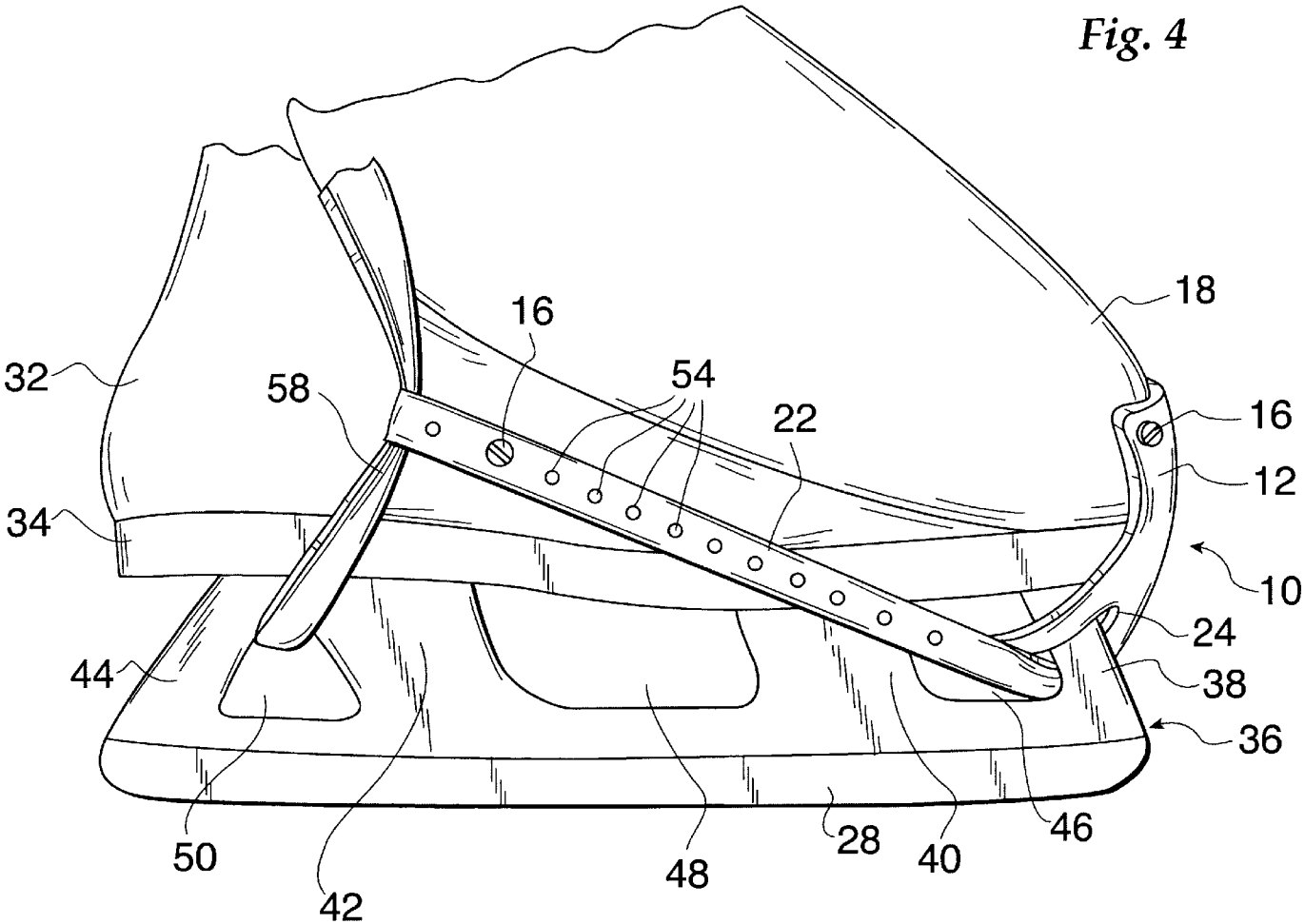
FIG. 4 is a side elevational view, similar to that of FIG. 2 wherein a transverse heel strap is threaded through looped ends of each band to secure the toe anchor.

In an alternate arrangement, loops 52 are formed at the ends of the bands for engagement with a goal pad transverse heel strap 58, as illustrated in FIG. 4.

In many instances, the goaltender's leg pad may include only a single transverse strap. The adjustment of the lengths of the bands and the determination of which of the transverse pad straps is to be drawn through the looped ends of the bands is a matter of goaltender preference.

It should be understood that the specific number of blade carrier openings a particular skate may have is not material to the invention. A single blade carrier opening or space will suffice. Further, the toe anchor of the present invention may serve equally in conjunction with the goaltender's leg pads utilized in sports other than ice hockey, for example, roller hockey.

Thus it will be seen that there is provided a goaltender's leg pad toe anchor which achieves the various aspects features and considerations of the present invention and which is well-suited to meet the conditions of practical usage.

Since various possible embodiments might be made of the present invention and since various changes might be made in the exemplary embodiments shown herein without departing from the spirit of the invention, it should be understood that all matter herein described or shown in the accompanying drawings is to be interpreted as illustrative and not in a limiting sense.

Having thus described the invention there is claimed as new and desired to be secured by Letters Patent:

1. A goaltender's leg pad toe anchor for positioning and securing a depending lower portion of a goaltender's leg pad to a toe portion of a goaltender's skate, the toe anchor being formed of a single piece of sheetlike material, the toe anchor comprising a houve attachable to a depending lower portion of a leg pad, a pair of bands extending from the houve and a loop formed at the end of each band, each loop being configured to receive a transverse strap extending from the goal pad.

2. A goaltender's leg pad toe anchor as constructed in accordance with claim 1 wherein the loop is formed at the end of each band by bending and folding a distal portion of each band.

3. A goaltender's leg pad toe anchor as constructed in accordance with claim 1 wherein the bands are adjustable in length.

4. A goaltender's leg pad toe anchor as constructed in accordance with claim 3 further including a plurality of apertures equidistantly spaced along each band, the loop being formed by folding over an end portion of each band at an adjusted length, with the fold being positioned so as to engage the transverse strap, the loop being secured by a fastener extending through registered apertures.

5. A goaltender's leg pad toe anchor as constructed in accordance with claim 4 wherein the fastener comprises a screw type hockey equipment fastener.

6. A goaltender's leg pad toe anchor as constructed in accordance with claim 1 wherein the sheetlike material comprises leather.

7. Sports equipment comprising a goaltender's leg pad, the leg pad having a depending lower portion, the leg pad configured to be worn by a goaltender, a skate configured to be worn by the goaltender, a leg pad toe anchor for maintaining the lower portion of the goal pad in engagement with the skate, the toe anchor comprising a houve attached to the lower portion of the leg pad, the houve including a pair of bands, the leg pad including a transverse strap, with the transverse strap extending from one lateral side of the leg pad to an opposite lateral side of the leg pad, the transverse strap engaging an underside portion of the skate, each of the bands being releasably attached to the transverse strap.

8. Sports equipment as constructed in accordance with claim 7 wherein the skate includes a sole, a carrier, the carrier being spaced from the sole by a plurality of webs, means for engaging a support surface being mounted to the carrier, the webs defining at least one transverse opening between the sole and the carrier, the bands being drawn under the skate sole and crossing one another in the transverse opening.

9. Sports equipment as constructed in accordance with claim 8 wherein the webs define a transverse toe opening and at least one further transverse opening, the bands being crossed in the toe opening, the transverse strap extending through the further transverse opening.

10. Sports equipment as constructed in accordance with claim 8 wherein the means for engaging the support surface comprises a blade, the sports equipment comprising ice hockey equipment.

11. Sports equipment as constructed in accordance with claim 7 wherein each of the bands includes a loop at its end, the transverse strap being threaded through the loop of each band.

12. Sports equipment as constructed in accordance with claim 7 wherein the toe anchor is formed of a single piece of sheetlike material.

13. Sports equipment as constructed in accordance with claim 12 wherein the sheetlike material comprises leather.

14. Sports equipments as constructed in accordance with claim 7 wherein the skate includes a shank and the transverse strap extends beneath the shank.

15. Sports equipment as constructed in accordance with claim 7 wherein the transverse strap comprises a heel strap.

16. A method of fitting a depending lower portion of a goaltender's leg pad to a toe portion of a goaltender's skate utilizing a sheetlike toe anchor comprising a houve and a pair of bands, the method comprising the steps of:

a) attaching the houve to the lower portion of the leg pad, b) drawing the houve toward the toe of the skate, c) crossing the bands in a transverse opening of a skate blade carrier, and d) adjusting the length of each band by folding over a distal portion of the band to form a loop, the loop being positioned for registration with a transverse strap of the leg pad.

17. A method of using a goaltender's leg pad fitted with a toe anchor in accordance with the steps of claim 16, the method comprising performing step b), performing step c) and:

e) engaging the transverse strap through each loop, and f) securing the transverse strap to a side portion of the leg pad.

18. A method of fitting in accordance with claim 16 further including the step of:

e) fixing the loops by extending a fastener through registered apertures in the band and in the folded over distal portion of the band.

* * * * *